US009706852B1

(12) United States Patent
Thomson

(10) Patent No.: US 9,706,852 B1
(45) Date of Patent: Jul. 18, 2017

(54) EARTHQUAKE PROTECTIVE SLEEP STRUCTURE

(71) Applicant: Karen Elaine Thomson, Rancho Santa Fe, CA (US)

(72) Inventor: Karen Elaine Thomson, Rancho Santa Fe, CA (US)

( * ) Notice: Subject to any disclaimer, the term of this patent is extended or adjusted under 35 U.S.C. 154(b) by 0 days.

(21) Appl. No.: 15/345,183

(22) Filed: Nov. 7, 2016

Related U.S. Application Data

(60) Provisional application No. 62/382,432, filed on Sep. 1, 2016.

(51) Int. Cl.

| | |
|---|---|
| ***A47C 31/00*** | (2006.01) |
| ***E04B 1/98*** | (2006.01) |
| ***A47C 19/02*** | (2006.01) |
| ***A47C 17/86*** | (2006.01) |

(52) U.S. Cl.
CPC ..... *A47C 31/002* (2013.01); *A47C 17/86* (2013.01); *A47C 19/025* (2013.01); *E04B 1/985* (2013.01)

(58) Field of Classification Search
CPC ..... A47C 21/08; A47C 19/20; A47C 19/22; A47C 31/002; E04B 1/98; E04B 1/985; E04H 9/02; E04H 9/021; E04H 9/028
USPC ..... 5/414, 2.1, 8, 9.1, 424, 1; 52/167.1, 52/167.3
See application file for complete search history.

(56) References Cited

U.S. PATENT DOCUMENTS

| | | | | | |
|---|---|---|---|---|---|
| 4,069,527 | A * | 1/1978 | Harris | A47C 31/002 | 5/414 |
| 4,779,294 | A * | 10/1988 | Miller | A47C 31/002 | 135/121 |
| 4,782,541 | A * | 11/1988 | Tuchman | A47C 31/002 | 403/166 |
| 4,965,895 | A * | 10/1990 | Shustov | A47C 31/002 | 248/346.11 |
| 5,241,717 | A * | 9/1993 | Ward | E04H 9/02 | 248/165 |
| 5,575,024 | A * | 11/1996 | You | A47C 31/002 | 5/308 |
| 5,615,424 | A * | 4/1997 | Nakata | A47C 31/002 | 5/2.1 |
| 5,662,132 | A * | 9/1997 | Larsen | E04H 9/02 | 135/137 |
| 5,737,784 | A * | 4/1998 | Jackman | A47C 31/002 | 5/286 |
| 6,101,769 | A * | 8/2000 | Hamill | A47C 31/002 | 5/14 |
| 6,360,384 | B1 * | 3/2002 | Kuempel | A47C 21/08 | 5/414 |
| 2005/0114995 | A1 * | 6/2005 | Nakata | A47C 31/002 | 5/2.1 |

* cited by examiner

*Primary Examiner* — Robert G Santos
(74) *Attorney, Agent, or Firm* — Donn K. Harms

(57) ABSTRACT

A protective sleep structure is provided which is adapted to protect occupants of a bed placed thereunder during an earthquake and the like. The structure includes an arched roof extending to a rectangular base supported by a plurality of truss panels formed as unitary structures. A canopy layer formed of solid material covering the arched roof provides additional structural rigidity as well as a shield against debris falling through the arched roof toward occupants below.

18 Claims, 2 Drawing Sheets

EARTHQUAKE PROTECTIVE SLEEP STRUCTURE

Figure 1:
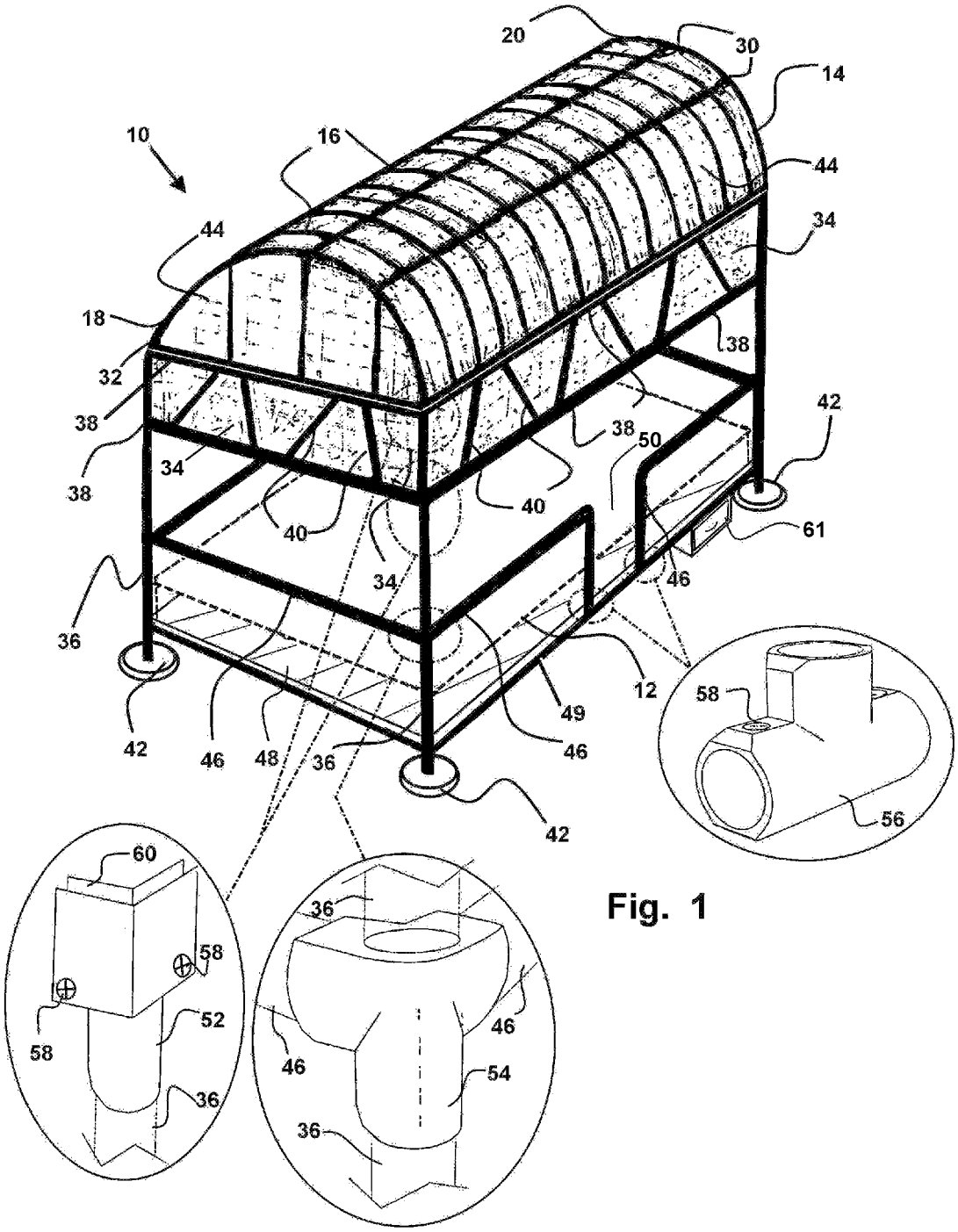

This application claims priority to U.S. Provisional Patent Application Ser. No. 62/382,432, filed on, Sep. 1, 2016.

BACKGROUND OF THE INVENTION

1. Field of the Invention

The present invention relates generally to bed frames adapted to hold and cover a mattress. More particularly, the invention relates to a bed frame structurally configured to protect the occupant of an underlying bed, from falling or flying debris inside the building in which the bed is located during an earthquake or other occurrence causing structural failure of the building.

2. Prior Art

Structural failure of buildings providing shelter to occupants such as homes, apartment houses, hotels, condominiums, hospitals, and other such buildings, is a common result of natural disasters such as earthquakes. Such structural failures of buildings in recent decades have also been a result of intentional or accidental explosions. While buildings are easily repaired or replaced subsequent to seismic damage, for the human occupants of a tremor-damaged structure, injuries and even death are likely outcomes which do not have such a simple solution.

Due to the fact that people spend up to a third of their lives sleeping, when they are in their dwelling or in a building providing a temporary dwelling, it is highly likely they will be in bed, and just as likely they will be asleep. Consequently, there is a high likelihood that during the time people occupy their own dwelling or a temporary dwelling such as a hotel, should the structure surrounding them be subjected to violent tremors, they will be in bed asleep. As such, people are in need of protection from injury or possible death from injuries caused by structural damage while they are in bed asleep and unaware of imminent danger and a device which will afford them a defense shield and refuge at all times.

In earthquake-prone areas of the world, it can be a harrowing experience for a person to lie in bed to go to sleep in what is essentially a vulnerable position with little or no protection. Such must be especially frightening for invalids, heavy sleepers or young family members in the household.

In prior art, numerous structures to protect sleeping occupants within buildings have been proposed. Many of the designs of such prior art are configured in a manner rendering them unsightly in appearance, or inadequate structurally to protect the bed occupants. Others teach complicated devices which employ mechanical drives, and hydraulic or spring-loaded mechanisms, which purport to provide various modes of protection to a bed occupant. However, these devices are expensive to manufacture and thus cost prohibitive for large portions of the population subjected to earthquakes.

Examples of the prior art providing less than adequate solutions are numerous. U.S. Pat. No. 4,490,864, to Wicker, teaches a bed and frame which is configured with a drawer positioned underneath the mattress. The bed occupant during an emergency is supposed to open the underlying drawer, and position themselves within its confines. Once so positioned, the user is supposed to slide the door closed, thereby enclosing them in the small confines of a drawer during the emergency. This device is less than adequate in that it requires the user to be awake and have the presence of mind to open a drawer and then somehow close it while they are within it. A user who fails to wake quickly enough or panics and does not occupy the drawer, is left with little protection. Further, the user is confined essentially to a coffin-like structure even if they occupy the drawer. Falling debris could surely trap them in the drawer once the emergency ceases.

Other prior art references listed on the Information Disclosure Statements filed herewith and made part hereof, are equally deficient in providing users a structure which will afford the user substantial protection against the perils of building destruction during natural and man-made disasters. The prior art provides structures which are unstable as well as being less than structurally sturdy, or are too heavy and too large for transport and placement within occupied structures due to door size limitations.

As such, there exists an unmet need for a bed support frame, which is configured to protect the occupant of the bed from injury or death caused by the structural failure of the dwelling in which the bed is positioned. Such a support frame should be configured with a roof or overhead covering, which is structurally configured so as to protect the bed occupant from falling debris, walls, ceilings, roofs, and other structural damage which occurs during either natural or man-made disasters. Still further, such a device should be lightweight as compared to the prior art to allow for easy transport and installation, and configurable from components to allow the components to pass through the narrow confines of a building. Further, such a device should be adapted for easy assembly once transported to the room of choice.

It should be noted, the foregoing examples of related art and limitations related therewith are intended to be illustrative and not exclusive, and they do not imply any limitations on the device and system described and claimed herein. Various limitations of the related art are already known or will become apparent to those skilled in the art upon a reading and understanding of the specification below and the accompanying drawings.

An object of the present invention is the provision of a bed frame which is structurally configured to protect the occupant and act as a defense shield and refuge should the building in which they sleep be damaged by earthquakes or other disasters.

It is another object of the invention to provide such a bed frame which, while structurally protective, is lightweight compared to existing art.

Yet a further object of this invention is the provision of such a protective bed frame, which may be assembled of components which are easily passed through narrow confines of a building and still form the frame herein having significantly enhanced strength.

Further objectives of the disclosed invention herein will be brought out in the following parts of the specification wherein the summary and detailed description of the invention are for the purpose of fully disclosing the invention without placing limitations thereon.

SUMMARY OF THE INVENTION

The present invention provides a solution to the noted shortcomings in the art for protective sleeping structures, through the provision of a bed-surrounding frame structure which is configured to protect the bed occupants from falling and flying debris during intense seismic trauma. The device employs a roof formed of a rigid semicircular arch infrastructure to yield a structure substantially stronger than the prior art.

The protective frame and overhead covering is formed preferably, of one or a plurality of lightweight high-strength materials, from a group of high-strength materials including thermoset fiber-reinforced plastics (FRP) such as fiberglass or carbon fiber suspended in vinylester or epoxy, aluminum, magnesium alloy, titanium alloy, and similar lightweight yet strong materials.

The arched roof is supported about a perimeter by truss supports formed as individual truss panels extending between corner posts. These truss panels are formed preferably as a unitary structure of FRP, by thermosetting a polyester or polymeric matrix which includes fibers of glass, carbon, or similar material. The resulting unitary structure of the truss panel yields significantly increased strength and support over trusses formed of welded or otherwise assembled components.

The supporting truss panels so formed, extend underneath both ends and along both sides of the arched roof. All truss panels, whether employed in a single canopy or dual canopy configuration of the device herein, are formed as a unitary structure as noted, and include at least two parallel longitudinal members extending between engagement to corner support posts.

Each truss panel includes a pair of parallel longitudinal members in the formed truss panel, and includes diagonal supports positioned therebetween, joined to form a continuous rigid structural engineering design known as a "Hat-Shaped Stiffened Beam," forming a superior component along the truss length.

The FRP truss panel configuration into a unitary thermoset structure, ensures that no individual support or member is subject to premature failure from bending or torsional straining forces. So configured, the truss panels provide support for the overlying arched roof members which are thereby significantly strengthened to resist tension and compression.

Consequently, the engaged truss panels formed in a unitary structure of FRP, provide significantly enhanced support for the arched roof and any load which might be imparted thereto from a disintegrating surrounding structure. Additionally, the enhanced resistance to tensional forces of the formed truss panels when connected to the uprights, aids in maintaining the uprights in a perpendicular positioning relative to the floor, where they are strongest at all times.

In a preferred mode of the device herein, each of the upright supports for the corners, and in cases of a wider bed, the centrally positioned uprights, is positioned upon a shock absorbing base. The shock absorbing base is positioned in a sandwiched engagement in-between the distal end of each upright and an underlying support surface or floor. Each base is preferably formed of a viscoelastic material such as sorbothane, which separates movement caused by floor translation during an earthquake, from communication to the uprights and connected structure.

Also in a preferred mode of the device and system herein, the arched roof is configured to deflect falling debris from landing on the bed occupants. This arched roof and optionally the sides of the truss panels are preferably covered by an attached solid and puncture-resistant canopy layer which may also be formed of fiber-reinforced plastics (FRP) such as fiberglass or carbon fiber suspended in vinylester or epoxy or other appropriate thermoset polymeric material. The canopy layer may be formed in sheets sized for engagement to the arched roof on site, if the bed is to be assembled. These sheets may be engaged to the arched roof with screws, clips, or complimentary fasteners positioned in operative engagement with both the arched roof and the covering.

The covering defined by this canopy layer forms an exterior surface of the arched roof which prevents debris from falling through the arched roof infrastructure. The covering or canopy layer is preferably formed of flexible but non elastic material which will not fold or buckle. In this form, the canopy layer will serve to provide shear support when engaged with the arched members of the arched roof to maintain their parallel positioning. As noted, a covering layer may be extended to engage over the outward facing surfaces of the truss panels to provide added protection from debris reaching the bed occupants, and to increase the shear strength of the underlying truss panels.

The frame so configured, is adapted at a position close to the floor, to operatively support a mattress and hold it elevated above the underlying surface. Metal mesh or similar support components adapted for supporting the mattress, may be removably engaged with the frame. Removal or elimination of the support components will allow for the positioning of a crib within the protective bed covering system.

To help maintain the bed occupant within, underneath, and protected by the structure above the operatively positioned mattress, guardrails are preferably engaged with the frame. The guardrails are preferably padded, and so positioned surrounding the mattress, to thereby provide a means to maintain the bed occupant within the confines of the structure. During an intense earthquake or other event which would cause severe shaking, the bed occupant might otherwise be tossed off the mattress. Openings operatively positioned in the guardrail provide for ingress and egress on both sides of the frame to accommodate room configuration.

Secured under the mattress supports would be an attachable drawer beneath the bed to hold emergency equipment such as flashlights, cell phone, radio, extra batteries, water, food, blankets, first aid kits, air filter masks, fire extinguishers, whistles, medications, bedpan, toilet paper, eyeglasses, etc. There will be a choice of multiple attachment points, depending on room arrangement and desire for additional drawers.

In all modes of the device herein, it is preferable that the frame is configured to be assembled on site. This is preferred because many homes and buildings have severely limited space in which to navigate the frame to the room of choice, and a fully assembled frame would be unable to traverse through narrow doorways and halls or areas with low ceilings. To that end, use of connective components which do not require forming a hole in the tubing or pipe forming the device is preferred since formation of such holes can weaken the tubing or pipe.

The frame is configurable to support and cover any sized mattress of either U.S. or international size standards. To accommodate such differing sized mattress configurations, the mattress in a preferred mode of the device herein, is suspended on a metal mesh support component adapted for removable engagement to the frame. Should excess space occur around the mattress in such a positioning, it may be filled with spacer pillows or the like.

The device may also be configured at manufacture to accommodate differing sized mattress configurations. In such an OEM configuration, the perimeter of the lower surface of the arched roof may be sized to cover and slightly exceed the perimeter of the underlying mattress. The FRP truss panels can also be adjusted in length to accommodate the perimeter size of the arched roof, and in doing so the angled cross-members, forming alternately inverted supports within the unitary truss panels, would vary in size and length to maintain a desired incline angle. An angle in a range between 40 to 50 degrees is preferred. Particularly preferred is an angle at 45 degrees of the cross-members relative to the parallel longitudinal members on opposing sides of the unitary truss panels.

With respect to the above description, before explaining at least one preferred embodiment of the herein disclosed bed frame system in detail, it is to be understood that the invention is not limited in its application to the details of construction and to the arrangement in the following description or illustrated in the drawings. The protective bed frame herein described is capable of other embodiments and of being practiced and carried out in various ways which will become obvious to those skilled in the art upon reading this disclosure. Also, it is to be understood that the phraseology and terminology employed herein are for the purpose of description and should not be regarded as limiting.

As such, those skilled in the art will appreciate that the conception upon which this disclosure is based, may readily be utilized as a basis for the designing of other bed protective systems and devices and for carrying out the several purposes of the present disclosed system. It is important, therefore, that the claims herein be regarded as including such equivalent construction and methodology, insofar as they do not depart from the spirit and scope of the present invention.

BRIEF DESCRIPTION OF DRAWING FIGURES

The accompanying drawings, which are incorporated herein and form a part of the specification, illustrate some, but not the only or exclusive examples of embodiments and/or features of the invention. It is intended that the embodiments and figures disclosed herein are to be considered illustrative rather than limiting.

In the drawings:

FIG. 1 a mode of the bed frame herein configured for protection of the bed of a single sleeper such as a twin, or queen bed or similar bed in an international standard size, or a crib.

Figure 2:
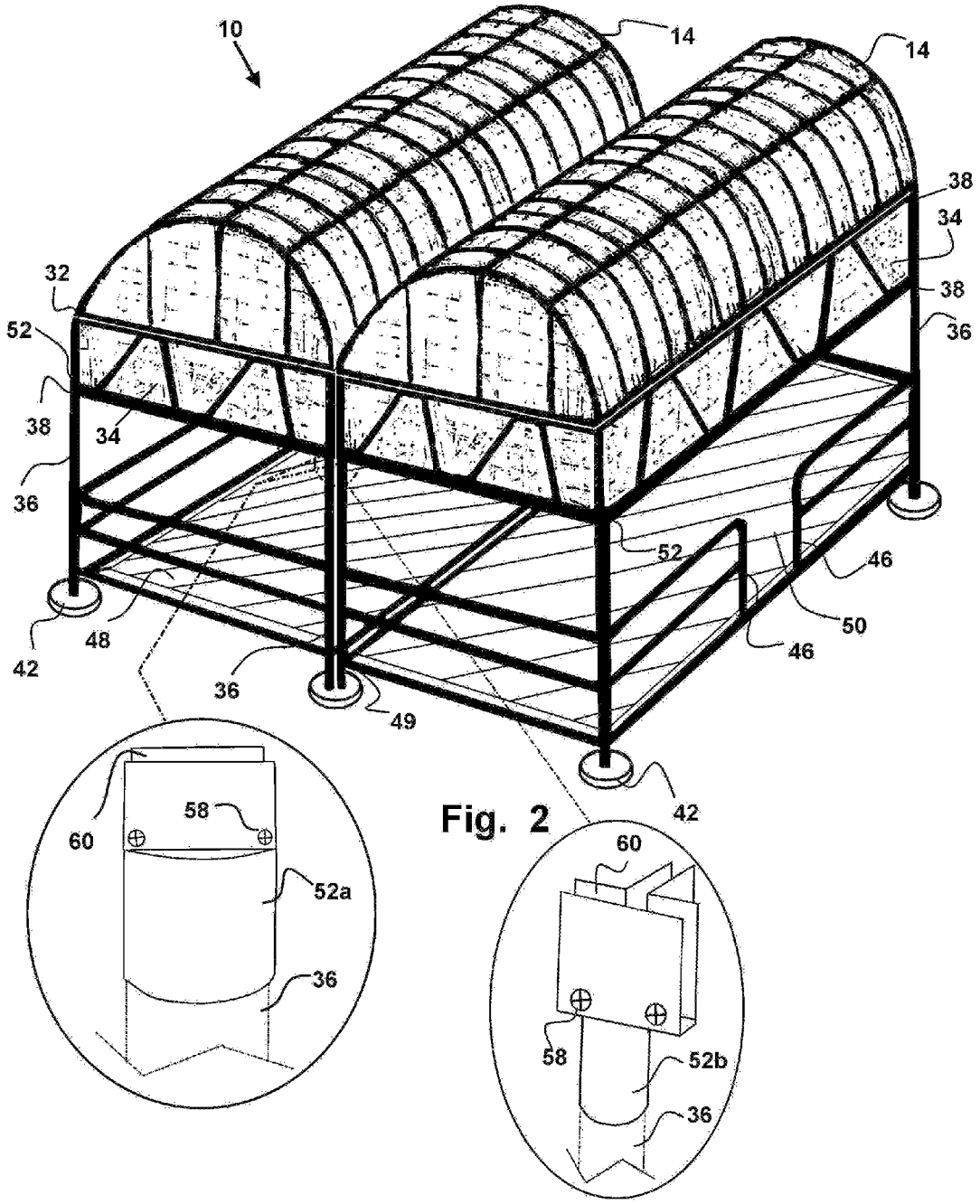

FIG. 2 depicts the device in a configuration adapted for protection of a bed for multiple occupants, such as those known in the United States as a king-size bed or a similar size by international standards showing a double arched roof and central uprights.

DETAILED DESCRIPTION OF THE PREFERRED

Embodiments of the Invention

In this description, any directional prepositions if employed, such as up, upwardly, down, downwardly, front, back, first, second, top, upper, bottom, lower, left, right and other such terms referring to the device or depictions as such may be oriented, are describing it such as it appears in the drawings and are used for convenience only. Such terms of direction and location are not intended to be limiting or to imply that the device herein has to be used or positioned in any particular orientation.

Now referring to drawings in FIGS. 1-2, wherein similar components are identified by like reference numerals, there is seen in FIG. 1 a preferred mode of the bed frame device 10 showing a preferred configuration which is adapted to hold and cover a mattress 12, which is sized for occupancy by a single user. As noted, there are various U.S. and international standards for the rectangular size, but all such mattresses are generally adapted for a single occupant.

The bed frame device 10 in this single-occupant mode of FIG. 1, has a roof 14 formed in a semicircular arch. The roof 14 includes a plurality of adjacent parallel arched members 16 which are positioned in parallel planes, and extend in this spaced relationship from a first end 18 to an opposite or second end 20 of the roof 14. A plurality of longitudinal support members 30 are engaged to each arched member 16 and extend perpendicular to the plane occupied by each arched member 16. These longitudinal support members 30 maintain each of the arched support members 16 perpendicular to both the support members 30 and the rectangular base 32 of the roof 14.

The rectangular base 32 of the arch shaped roof 14, is supported atop four truss panels 34, each of which engages at opposite ends with upright posts 36 in this single occupant mode of the device 10. All four truss panels 34 are formed of parallel longitudinal members 38, each of which extends to operative engagements with the upright posts 36.

Engaged between each pair of the parallel longitudinal members 38, in the FRP formed unitary truss panel 34, is positioned a plurality of stiffening members 40, each of which has one end engaged to one of the longitudinal members 38 running at an angle to each of between 40-50 degrees. A favored angle of the stiffening members 40 in the formed truss panels 34 is a uniform 45 degree angle of each, relative to the line running along each of the parallel longitudinal members 38 on opposing sides along the length of each unitary truss panel 34.

As also can be seen in FIGS. 1 and 2, preferably each of the upright posts 36, is supported upon a shock absorbing base 42. Each base 42 as noted, is preferably formed of a viscoelastic material such as sorbothane. This provides a means to separate the movement of floor translation during an earthquake, from a communication to the posts 36.

Also in all preferred modes of the device 10 the arched roof 14, has a solid substantially puncture-resistant canopy layer 44 engaged with the arched members 16. This canopy layer 44 may also extend to cover the exterior surfaces of the truss panels 34 defining the rectangular base 32. The canopy layer 44 is formed of material which will deflect falling debris from landing on the bed occupants. Further, the canopy layer 44 will not fold and will maintain a planar configuration.

Particularly preferred for the canopy layer 44, is formation in a unitary structure of thermoset fiber-reinforced plastics (FRP) such as fiberglass or carbon fiber suspended in vinylester or epoxy. The formation of the canopy layer 44 may be in thin but flexible sheets of thermoset FRP forming a puncture-resistant and strong layer. This forms sheets which will maintain their shape, and will not fold or buckle. The sheets forming the canopy layer 44 may be affixed to the curved arched roof by bending the sheets forming the canopy layer 44, and engaging them with the arched members 16 of the formed arched roof 14 using mating fasteners between the two, such as screws, clips, or similar complimentary fasteners.

In all modes of the device 10, the canopy layer is formed of stiff material. By stiff is meant that the canopy layer, while bendable to conform to the arch of the arched roof 14, is not compressible and will not elongate. By using a canopy layer 44 which is formed of stiff material, the canopy layer 44, when engaged to each of the plurality of arched members 16, forms a brace to maintain their relative positioning. Thus, the brace formed by this engagement will prevent any bending or movement of the arched members 16 from their spacing or their spaced positioning relative to each other.

This canopy layer 44 as shown, may also be extended to cover the outward facing surfaces of the truss panels 34, to provide added protection from debris and to reinforce the underlying truss panels 34. The canopy layer 44 is preferably formed of thermoset FRP, but if formed of other material such as metal mesh or KEVLAR or the like, it should be resistant to puncturing and tearing to thereby define an overhead shield to the bed occupant and prevent debris from falling through the arched roof 14.

The device 10 in all modes, is adapted to operatively engage and surround a mattress 12 in a manner to hold it elevated above the underlying surface or floor, and underneath the roof 14. A planar mesh, or similar mattress support 48 may be removably engaged to the frame using screws, clips, or other fasteners. So positioned, the mattress support 48 is thereby elevated above the floor, and adapted to operatively hold the mattress 12 thereon and elevated above the floor. However, as noted because it is removably engageable, the mattress support 48, can be removed or eliminated in some configurations of the device 10 at the option of the user. This will allow for positioning of a crib under the roof 14 of protective device 10 herein.

Guardrails 46 which are preferably padded, are operatively engaged with the posts 36 and a support rail 49 and configured to surround mattress 12 as a means to maintain the bed occupant within the confines of the structure. Openings 50, formed in-between the guardrails 46 may be positioned on both sides of the device 10. These openings 50, so positioned, provide for ingress and egress on either side of the assembled device 10 to accommodate room arrangement and the positioning of the assembled device 10 in various locations within the room.

In all modes of the device 10, the various components are provided for assembly once within the room of choice to allow for movement of the device 10 through narrow hallways and doors. Fittings such as first fitting 52, second fitting 54, and third fitting 56, are configured to slidably engage with the tubing employed to construct the device herein. Such fittings preferably employ a set screw 58 type of engagement with the tubing inserted therein, to secure it.

As shown, the first fitting 52, is configured to support the opposing ends of each employed truss panel 34 herein, at the corners of the assembled device 10. A pair of perpendicular slots 60 are configured in this first fitting 52, to frictionally engage both sides of each truss panel 34 when inserted therein, whereafter the set screw 58 or other means for locking the inserted truss panel 34 into engagement is used. Also shown is the second fitting 54, which is configured to slidably engage upon a central area of each post 36, and to slidably engage and hold the horizontally disposed distal ends of the guardrails 46 to the assembled frame of the device 10. Vertically disposed ends of the guardrails 46 are engaged to the underlying support rails 49, by the third fitting 56, which is configured to allow a central area of the support rail to slide therethrough and to engage and lock to a vertically disposed end of the guardrails 46.

Of course, the fittings employed to hold the tubing and the components forming the device 10 can change, should bends and positioning of respective tubing, rails, and uprights change, and such is anticipated. Consequently, any fitting configured to slidably engage the tubing of the device 10 and hold components such as the truss panels 34, roof 14, and posts 36, in operative locked engagement without forming holes, is anticipated within the scope of this patent.

Additionally shown in FIG. 1, but also positionable in the mode of the device of FIG. 2, one or a plurality of drawers 61, may be secured under the mattress supports on rails engaged to the frame underneath the plane occupied by the mattress support 48.

This positioning of the drawer 61, will render it easily found in a crisis situation, and protect the contents, such as flashlights, cell phone, radio, extra batteries, water, food, blankets, first aid kits, air filter masks, fire extinguishers, whistles, medications, bedpan, toilet paper, eyeglasses, and other emergency supplies from being crushed. Supports to hold the sliding drawer 61 or drawers, can be engaged with the support rails 49 in multiple positions, which will allow the user to choose the positioning of the drawer 61 depending on the room arrangement and desire for one or additional drawers.

Shown in FIG. 2, is a mode of the device 10 which is configured to cover a double-occupancy sized mattress 12 (see FIG. 1). The underlying planar mattress support 48 is removably engaged to the assembled frame within the perimeter of the support rails 49. The formed device 10 as shown in FIG. 2, employs two frames as depicted in FIG. 1, which are positioned to abut each other. However, the multiple bed occupant mode of FIG. 2 may also be formed as a single structure which may eliminate poles 36 at the mid section, or employ a single pole 36 in that position and operatively connect the pole 36 and truss panels 34 using a T-fitting 52*b*, or forming other fittings to support the truss panels 34 as used, upon pole 36.

The device 10 as in FIG. 2, is especially well adapted to protect multiple occupants positioned underneath the pair of adjacent roofs 14. Each of the roofs 14 is configured in the same manner as noted above, and each is supported about a perimeter of a base 32, by underlying truss panels 34 operatively connected to upright posts 36, such as with first fittings 52 at the corners.

Truss panels 34 at the interior of the adjoined units may not be affixed, so as to allow less confinement of interior space.

In this mode of the device 10, the slots 60 in the first fitting 52 may be reconfigured to a single slot 60, such as shown as 52*a* or 52*b* in FIG. 2, which may be used for engagement at the central portion of the device 10 where one, or preferably two poles 36, support the corners of the roofs 14. Where two poles 36 are employed for a significant increase in strength of the multi occupant mode of the device 10, each of the two poles 36, will have a slotted fitting such as 52*a* with a locking mechanism such as the set screws 58. Alternatively, a multi directional fitting 52*b* may be employed to engage one or a pair of truss panels 34 positioned at the head and foot of the formed device 10, and to operatively engage a truss panel 34 communicating between a centrally located pole 36.

Additionally, where two centrally located poles 36 are employed, which is preferred, two centrally positioned truss panels 34 would extend between each opposing pairs of poles 36. Where one pole 36 is employed in this central area of the structure, a single truss panel 34 would support both the head and end portions of the rectangular base 32 of the two arched roofs 14. Fitting 52*b* can accommodate any of these configurations, or variations thereon. A shock-absorbing base 42 adapted for positioning of two abutting poles 36 thereon, may be employed in configurations using two centrally located poles 36. Where support rails 49 abut, and a single centrally located pole 36 is employed, fitting 56 having a vertical passage running completely therethrough in-between the rails 49, can be employed to terminate the rails 49 to a single pole 36, and an adapted fitting 54 having a horizontal aligned engagement for rails 49, rather than the perpendicular engagement of longitudinal members 46 as shown, may be employed.

The remainder of the modular components used for connecting the various components of the device 10, such as releasable connectors shown as fittings 52-56, or other fittings which are adapted to the task, may be removably locked to the respective components they connect, using a locking mechanism such as the disclosed set screw 58. Also shown in FIG. 2, is the planar mattress support 48 which, as noted, is preferably removably engageable to the formed frame of the device 10, such as to the support rail 49. This removable engagement will allow the mattress support 48 to be removed so other types of beds such as cribs, or other furniture may be positioned underneath the protective roofs 14.

While all of the fundamental characteristics and features of the protective bed covering system herein have been shown and described herein, with reference to particular embodiments thereof, a latitude of modification, various changes, and substitutions are intended in the foregoing disclosure and it will be apparent that in some instances, some features of the invention may be employed without a corresponding use of other features without departing from the scope of the invention as set forth. It should also be understood that upon reading this disclosure and becoming aware of the disclosed novel and useful device and system herein disclosed, that various substitutions, modifications, and variations may occur to and be made by those skilled in the art, without departing from the spirit or scope of the invention. Consequently, all such modifications, variations, and substitutions, as would occur to those skilled in the art are considered included within the scope of the invention as defined by the following claims.

What is claimed is:

1. An earthquake protective sleep structure apparatus, comprising:

an arched roof, said arched roof having a plurality of adjacent arched members, each said arched member having two ends engaged with a rectangular base;

said rectangular base supported upon a plurality of truss panels;

said plurality of truss panels including a first pair of truss panels running parallel and extending between respective first ends, each of which is engaged to a respective upper end of one of a respective first pair of poles, to respective second ends each of which engaged to a respective upper end of one of a respective second pair of poles;

said plurality of truss panels including a second pair of truss panels, a first truss panel of said second pair extending between engagements of opposing ends thereof with said first pair of poles, a second truss panel of said second pair extending between engagements of opposing ends thereof with said second pair of poles, and running parallel to said first truss panel of said second pair;

each of said first pair of poles and said second pair of poles having a respective lower end opposite a respective said upper end, each said lower end configured for positioning on a floor and each said truss panel being held elevated above said floor; and said arched roof while held elevated above said floor supported at said upper ends of said plurality of poles, in an elevated position, defines a protected area where debris falling from above said roof is prevented from entering, said protected area extending from a perimeter of said rectangular base to said floor.

2. The earthquake protective sleep structure apparatus of claim 1, additionally comprising:

a canopy layer formed of stiff material;

said canopy layer in a respective engagement with each of said plurality of adjacent arched members;

said respective engagement of said canopy layer with each of said plurality of adjacent arched members forming a brace between each of said plurality of adjacent arched members to fix a spacing therebetween; and said canopy layer forming an upper surface of said arched roof.

3. The earthquake protective sleep structure apparatus of claim 1, additionally comprising:

each of said truss panels in said plurality of truss panels formed by a pair of parallel longitudinal members having a gap therebetween, each of said longitudinal members extending to said opposing ends;

a plurality of stiffening members extending across said gap and engaged at opposite ends with a respective one of said longitudinal members; and said stiffening members extending at an angle across said gap of between 40-50 degrees relative to said pair of parallel longitudinal members.

4. The earthquake protective sleep structure apparatus of claim 2, additionally comprising:

each of said truss panels in said plurality of truss panels formed by a pair of parallel longitudinal members having a gap therebetween, each of said longitudinal members extending to said opposing ends;

a plurality of stiffening members extending across said gap and engaged at opposite ends with a respective one of said longitudinal members; and said stiffening members extending at an angle across said gap of between 40-50 degrees relative to said pair of parallel longitudinal members.

5. The earthquake protective sleep structure apparatus of claim 3, additionally comprising:

said angle of said stiffening members across said gap being 45 degrees.

6. The earthquake protective sleep structure apparatus of claim 4, additionally comprising:

said angle of said stiffening members across said gap being 45 degrees.

7. The earthquake protective sleep structure apparatus of claim 3, additionally comprising:

each of said truss panels formed with said longitudinal members and said stiffening members in a unitary structure comprised of fiber-reinforced plastics.

8. The earthquake protective sleep structure apparatus of claim 4, additionally comprising:

each of said truss panels formed with said longitudinal members and said stiffening members in a unitary structure comprised of fiber-reinforced plastics.

9. The earthquake protective sleep structure apparatus of claim 5, additionally comprising:

each of said truss panels formed with said longitudinal members and said stiffening members in a unitary structure comprised of fiber-reinforced plastics.

10. The earthquake protective sleep structure apparatus of claim 6, additionally comprising:

each of said truss panels formed with said longitudinal members and said stiffening members in a unitary structure comprised of fiber-reinforced plastics.

11. The earthquake protective sleep structure apparatus of claim 9 additionally comprising:

a viscoelastic base in a sandwiched position between each said lower end of each said pole and said floor.

12. The earthquake protective sleep structure apparatus of claim 10 additionally comprising:

a viscoelastic base in a sandwiched position between each said lower end of each said pole and said floor.

13. The earthquake protective sleep structure apparatus of claim 4 additionally comprising:

said protective sleep structure having a pair of said arched roofs posited adjacent each other.

14. The earthquake protective sleep structure apparatus of claim 6 additionally comprising:

said protective sleep structure having a pair of said arched roofs posited adjacent each other.

15. The earthquake protective sleep structure apparatus of claim 10 additionally comprising:

said protective sleep structure having a pair of said arched roofs posited adjacent each other.

16. The earthquake protective sleep structure apparatus of claim 12 additionally comprising:

said protective sleep structure having a pair of said arched roofs posited adjacent each other.

17. The earthquake protective sleep structure apparatus of claim 8 wherein said formed truss panels formed to a unitary structure comprised of fiber-reinforced plastics are formed as a Hat-Shaped Stiffened Beam along an entire length of each said truss panel.

18. The earthquake protective sleep structure apparatus of claim 9 wherein said formed truss panels formed to a unitary structure comprised of fiber-reinforced plastics are formed as a Hat-Shaped Stiffened Beam along an entire length of each said truss panel.

* * * * *